US006326336B1

(12) United States Patent
Gatto et al.

(10) Patent No.: US 6,326,336 B1
(45) Date of Patent: Dec. 4, 2001

(54) TURBINE OILS WITH EXCELLENT HIGH TEMPERATURE OXIDATIVE STABILITY

(75) Inventors: Vincent James Gatto, Midlothian, VA (US); Helen Ryan, London (NL); Ramnath Narayan Iyer, Midlothian, VA (US)

(73) Assignee: Ethyl Corporation, Richmond, VA (US)

( * ) Notice: Subject to any disclaimer, the term of this patent is extended or adjusted under 35 U.S.C. 154(b) by 0 days.

(21) Appl. No.: 09/173,794

(22) Filed: Oct. 16, 1998

(51) Int. Cl.[7] ..... C10M 141/08; C10M 141/10

(52) U.S. Cl. ..... 508/290; 508/322; 508/331; 508/328; 508/355; 508/464

(58) Field of Search ..... 508/331, 328, 508/322, 290, 355, 464

(56) References Cited

U.S. PATENT DOCUMENTS

| | | | | |
|---|---|---|---|---|
| 3,230,168 | | 1/1966 | Hans Low | 252/33.6 |
| 3,876,550 | | 4/1975 | Holubec | 252/47.5 |
| 3,992,307 | * | 11/1976 | Hotten | 508/272 |
| 4,119,551 | | 10/1978 | Yaffe | 252/46.7 |
| 4,125,479 | | 11/1978 | Chesluk et al. | 252/33.6 |
| 4,226,732 | | 10/1980 | Reinhard et al. | 252/32.5 |
| 4,427,561 | * | 1/1984 | Kusayanagi et al. | 252/68 |
| 4,648,985 | | 3/1987 | Thorsell et al. | 252/32.5 |
| 4,859,352 | | 8/1989 | Waynick | 252/41 |
| 4,880,551 | | 11/1989 | Doe | 252/47.5 |
| 5,137,980 | * | 8/1992 | DeGonia et al. | 508/455 |
| 5,236,610 | | 8/1993 | Perez et al. | 252/56 S |
| 5,275,749 | | 1/1994 | Kugel et al. | 252/51.5 |
| 5,346,635 | | 9/1994 | Khorramian | 252/33.3 |
| 5,366,646 | | 11/1994 | Sato et al. | 252/49.8 |
| 5,366,648 | | 11/1994 | Salomon et al. | 252/42.7 |
| 5,439,605 | | 8/1995 | Khorramian | 252/33.3 |
| 5,498,355 | * | 3/1996 | Perozzi et al. | 508/454 |
| 5,714,441 | * | 2/1998 | Berlowitz | 508/479 |
| 5,726,135 | * | 3/1998 | Khorramian | 508/444 |
| 5,750,478 | * | 5/1998 | Kim et al. | 508/331 |
| 5,801,130 | * | 9/1998 | Francisco et al. | 508/272 |
| 6,165,951 | | 12/2000 | Leonhardt . | |

FOREIGN PATENT DOCUMENTS

| | | |
|---|---|---|
| 0528610 | 2/1993 | (EP) . |
| 0588561 | 3/1994 | (EP) . |
| 0628622 | 12/1994 | (EP) . |
| 0735128 | 10/1996 | (EP) . |
| 810741 | 3/1959 | (GB) . |
| 92/19703 | 11/1992 | (WO) . |

OTHER PUBLICATIONS

Application and Maintenance, CRC Press Inc. pp. 406–409.
Booser Ph. D. *Handbook of Lubrication*, Theory and Practice of Tribology, vol. I, 1983.*

* cited by examiner

*Primary Examiner*—Margaret Medley
(74) *Attorney, Agent, or Firm*—Thomas Hamilton; James T. Moore

(57) ABSTRACT

A turbine lubricant consisting of (A) alkylated diphenylamine and/or phenylnaphthylamines, and (B) sulfurized olefins and/or sulfurized fatty acids and/or ashless dithiocarbamates and/or tetraalkylthiuram disulfides, with the balance containing (C) base oils characterized by very low sulfur contents (<0.03 wt %) and a high level of saturates (>90 volume %), and optionally (D) neutral rust inhibitors, show superior oxidative stability and provide adequate corrosion protection and sludge control for turbine oil and R&O oil applications.

22 Claims, 2 Drawing Sheets

TURBINE OILS WITH EXCELLENT HIGH TEMPERATURE OXIDATIVE STABILITY

TECHNICAL FIELD

The present invention is directed to turbine, rust and oxidation (R&O) and ashless hydraulic oils (hereinafter collectively referred to as "turbine oils") having excellent high temperature oxidative stability. A further object of this invention is to deliver this level of oxidation protection without sacrificing sludge control and without the need for phenolic antioxidants.

BACKGROUND OF THE INVENTION

Steam and gas turbine oils are top-quality rust- and oxidation-inhibited oils. Steam turbines employ steam that enters the turbine at high temperature and pressure and expands across both rotating and fixed blades. Only the highest-quality lubricants are able to withstand the wet conditions, high temperatures and long periods of service associated with steam turbine operation. In gas turbines, they must withstand contact with very hot surfaces, often with intermittent operation and periods of nonuse. Therefore, to be effective, both types of oil must have, in addition to good corrosion protection and demulsibility, outstanding resistance to oxidation, which includes a minimum tendency to form deposits in critical areas of the system.

To achieve these desired properties, it is necessary to formulate these oils using a carefully balanced additive package. The nature of these fluids makes them very susceptible to contamination, particularly from other lubricants and additives. A relatively small degree of contamination can markedly affect the properties and expected service life of these lubricants. Further, to maintain effective operating conditions and to avoid damaging the equipment in which they are used, turbine oils should be kept meticulously clean and free of contaminants. Contamination is minimized by filtration of the turbine oils. To ensure that the turbine oils are substantially free of contaminants very fine filters are used.

The ratio between power output of turbines and oil volume has increased considerably over the years. This has resulted in a substantial increase in turbine operating temperatures. Therefore, it is necessary to protect the lubricant from oxidative degradation. The use of more antioxidants is one possible solution but higher treat levels sometimes lead to other problems such as sludge formation and solubility difficulties. A better approach is the use of synergistic antioxidant combinations, such as those taught in the present invention, that provide improved oxidation performance without causing sludge formation.

Due to the requirements of turbine oils, only a few classes of additives, relative to other types of lubricating compositions, are combined with the base oils. Generally, a finished turbine oil will contain only the base oil, antioxidants, rust inhibitors, demulsifiers, corrosion inhibitors and diluents, if necessary.

EP 0735128 A2 discloses extended life rust and oxidation oils comprising a dithiocarbamate and an alkylphenyl-α-naphthylamine. This reference does not teach the use of Group II or higher (i.e., Group III or Group IV) base oils, or the advantages obtained thereby, as required by the present invention.

SUMMARY OF THE INVENTION

This invention describes the use of a two component antioxidant system that provides superior oxidation protection and acceptable sludge control in turbine oils formulated with Group II or higher base oils. The highly oxidatively stable lubricants of the present invention comprise (A) an amine antioxidant selected from the group consisting of alkylated diphenylamines, phenyl-naphthylamines and mixtures thereof, (B) sulfur containing additives selected from the group consisting of sulfurized olefins, sulfurized fatty acids, ashless dithiocarbamates, tetraalkylthiuram disulfides and mixtures thereof, and (C) a base oil characterized by very low sulfur contents (<0.03 wt. %) and a high level of saturates (>90 volume %). In another embodiment of the present invention, the highly oxidatively stable lubricants further contain (D) at least one rust inhibitor.

BRIEF DESCRIPTION OF THE DRAWINGS

Certain characteristics of the present invention will be described in detail below with reference to the drawings, wherein.

DETAILED DESCRIPTION OF THE INVENTION

Figure 1:
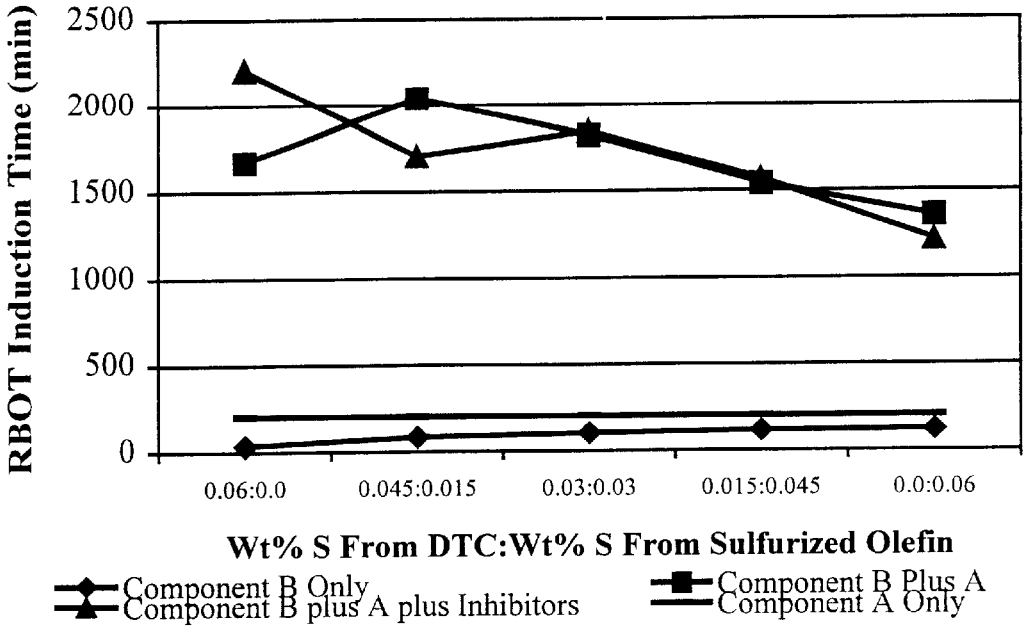
FIG. 1 is a graph illustrating the benefits obtained by using a combination of sulfurized additives and amine antioxidants in hydrotreated, low sulfur Group II oils.

The present invention is directed to turbine lubricating oils comprising (A) an amine antioxidant selected from the group consisting of alkylated diphenylamines, phenyl-naphthylamines and mixtures thereof, (B) sulfur containing additives selected from the group consisting of sulfurized olefins, sulfurized fatty acids, ashless dithiocarbamates, tetraalkylthiuram disulfides and mixtures thereof, and (C) a base oil characterized by very low sulfur contents (<0.03 wt. %) and a high level of saturates (>90 volume %).

In another embodiment of the present invention, the turbine lubricating oils further contain (D) at least one rust inhibitor.

Component A—Amine Antioxidants

The amine antioxidants suitable for use in the present invention should be soluble in the turbine oil package. The amine antioxidant is selected from the group consisting of alkylated diphenylamines, phenyl-naphthylamines and mixtures thereof. Examples of amine antioxidants that may be used in this invention include, but are not limited to, diphenylamine, phenyl-alpha-naphthylamine, phenyl-beta-naphthylamine, butyldiphenylamine, dibutyldiphenylamine, octyldiphenylamine, dioctyldiphenylamine, nonyldiphenylamine, dinonyldiphenylamine, heptyldiphenylamine, diheptyldiphenylamine, methylstyrylldiphenylamine mixed butyl/octyl alkylated diphenylamines, mixed butyl/styryl alkylated diphenylamines, mixed nonyl/ethyl alkylated diphenylamines, mixed octyl/styryl alkylated diphenylamines, mixed ethyl/methylstyryl alkylated diphenylamines, octyl alkylated phenyl-alpha-naphthylamine, mixed alkylated phenyl-alpha-naphthylamines, and combinations of these at varying degrees of purity that are commonly used in the petroleum industry. Examples of commercial diphenylamines include, but are not limited to, Irganox® L06, Irganox® L57, and Irganox® L67 from Ciba Specialty Chemicals; Naugalube® AMS, Naugalube® 438, Naugalube® 438R, Naugalube® 438L, Naugalube® 500, Naugalube® 640, Naugalube® 680, and Naugard® PANA from Uniroyal Chemical Company; Goodrite® 3123, Goodrite® 3190X36, Goodrite®

3127, Goodrite® 3128, Goodrite® 3185X1, Goodrite® 3190X29, Goodrite® 3190X40, and Goodrite® 3191 from BFGoodrich Specialty Chemicals; HiTEC® 569 antioxidant and HiTEC® 4793 antioxidant available from Ethyl Corporation; Vanlube® DND, Vanlube® NA, Vanlube® PNA, Vanlube® SL, Vanlube® SLHP, Vanlube® SS, Vanlube® 81, Vanlube® 848, and Vanlube® 849 from R. T. Vanderbilt Company, Inc. These amine antioxidants are generally characterized by their nitrogen content and TBN as determined by ASTM D 2896. It is preferred that the nitrogen content of the amine antioxidants be between 3.0 and 7.0 wt % and the TBN be between 100 and 250 mg KOH/g of the neat, i.e. undiluted, additive concentrate.

The concentration of amine antioxidants in the finished oil can vary depending upon the basestock used, customer requirements and applications, and the desired level of antioxidant protection required for the specific turbine oil. Typically, the amine antioxidant is present in the finished turbine oil in an amount of from 0.04 wt % to 0.5 wt %, preferably, 0.05 wt % to 0.3 wt. %.

Component B—Sulfur-containing Compound

The sulfur-containing compounds of the present invention are selected from the group consisting of sulfurized olefins, sulfurized fatty acids, ashless dithiocarbamates, tetraalkylthiuram disulfides and mixtures thereof. The sulfurized olefins suitable for use in the present invention may be prepared by a number of known methods. They are characterized by the type of olefin used in their production and their final sulfur content. High molecular weight olefins (e.g., those having an average molecular weight (Mn) of from about 112 to about 351 g/mole) are preferred. Examples of olefins that may be used include alpha-olefins, isomerized alpha-olefins, branched olefins, cyclic olefins, polymeric olefins and mixtures thereof. Examples of alpha olefins that may be used include 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, 1-eicosene, 1-heneicosene, 1-docosene, 1-tricosene, 1-tetracosene, 1-pentacosene and mixtures thereof. Alpha olefins may be isomerized before the sulfurization reaction or during the sulfurization reaction. Structural and/or conformational isomers of the alpha olefins that contain internal double bonds or branching may also be used. For example, isobutylene is the branched olefin counterpart of the alpha olefin 1-butene.

Sulfur sources that may be used in the sulfurization reaction can include, for example, elemental sulfur, sulfur monochloride, sulfur dichloride, sodium sulfide, sodium polysulfide, and mixtures thereof added together or at different stages of the sulfurization process.

Unsaturated fatty acids and oils, because of their unsaturation, may also be sulfurized and used in this invention. Examples of fatty acids that may be used include lauroleic acid, myristoleic acid, palmitoleic acid, oleic acid, elaidic acid, vaccenic acid, linoleic acid, linolenic acid, gadoleic acid, arachidonic acid, erucic acid, and mixtures of these. Examples of oils or fats that may be used include corn oil, cottonseed oil, grapeseed oil, olive oil, palm oil, peanut oil, rapeseed oil, safflower seed oil, sesame seed oil, soybean oil, sunflower oil, sunflower seed oil, and combinations thereof.

The ashless dithiocarbamates and tetraalkylthiuram disulfides suitable for use in the present invention are preferably soluble in the turbine oil package. Examples of ashless dithiocarbamates that may be used include, but are not limited to, methylenebis(dialkyldithiocarbamate), ethylenebis(dialkyldithiocarbamate), and isobutyl disulfide-2,2'-bis(dialkyldithiocarbamate), where the alkyl groups of the dialkyldithiocarbamate can preferably have from 1 to 16 carbons. Examples of preferred ashless dithiocarbamates are methylenebis(dibutyldithiocarbamate), ethylenebis (dibutyldithiocarbamate), and isobutyl disulfide-2,2'-bis (dibutyldithiocarbamate). Examples of preferred tetraalkylthiuram disulfides that may be used include tetrabutylthiuram disulfide and tetraoctylthiuram disulfide.

The concentration of Component B in the finished turbine oil can vary depending upon the customers' requirements and applications, and the desired level of antioxidant protection required for the specific turbine oil. An important criteria for selecting the concentration of Component B used in the turbine oil is the sulfur content. Component B should deliver between 0.005 wt. % and 0.07 wt. % of sulfur to the finished turbine oil. For example, a sulfurized olefin containing 12 wt. % sulfur content should be used between 0.04 wt. % and 0.58 wt. % to deliver between 0.005 wt. % and 0.07 wt. % sulfur to the finished turbine oil. An ashless dithiocarbamate containing 30 wt. % sulfur content should be used between 0.02 wt. % and 0.23 wt. % to deliver between 0.005 wt. % and 0.07 wt. % sulfur to the finished oil.

Another criterion useful for selecting Component B is the material's content of active sulfur as determined by ASTM D 1662. The presence of high levels of active sulfur can lead to significant corrosion and sludge problems in the finished turbine oil. In a preferred embodiment of the present invention, the level of active sulfur in Component B is below 1.5 wt. % as determined by ASTM D 1662.

An example of a commercial sulfurized olefin that may be used in this invention is HiTEC® 7188 sulfurized olefin, which contains approximately 12 wt. % total sulfur content and <1 wt. % active sulfur, available from Ethyl Corporation. Examples of commercial sulfurized fatty oils or mixtures of sulfurized fatty oils and olefins, that may be used in this invention include Additin® R 4410 which contains approximately 9.5 wt. % sulfur content and 1 wt. % active sulfur, Additin® R 4412 F which contains approximately 12.5 wt. % sulfur content and 1.5 wt. % active sulfur, and Additin® RC 2810-A which contains approximately 10 wt. % sulfur content and <1 wt. % active sulfur, all from Rhein Chemie Corporation. An example of a commercial ashless dithiocarbamate that may be used in this invention is Vanlube® 7723 which contains approximately 30 wt. % sulfur from R. T. Vanderbilt Company. From a practical standpoint Component B should contain a minimum of 8.0 wt % sulfur in order to minimize the amount of additive needed to deliver the required amount of sulfur. This is desired in order to control cost of the turbine oil package.

Mixtures of sulfurized olefins, ashless dithiocarbamates and tetraalkylthiuram disulfides, in varying proportions, may also be used, as long as the desired total sulfur content, and active sulfur content are satisfied.

Component C—Base Oil

The base oils suitable for use in the present invention are characterized by very low sulfur contents (<0.03 wt. %) and a high level of saturates (>90 volume %).

Group II and Group III basestocks are particularly suitable for use in the present invention, and are typically prepared from conventional feedstocks using a severe hydrogenation step to reduce the aromatic, sulfur and nitrogen content, followed by dewaxing, hydrofinishing, extraction and/or distillation steps to produce the finished base oil. Group II and III basestocks differ from conventional solvent refined Group I basestocks in that their sulfur, nitrogen and aromatic contents are very low. As a result, these base oils are compositionally very different from conventional solvent refined basestocks. The American Petroleum Institute has categorized these different basestock types as follows: Group I, >0.03 wt. % sulfur, and/or <90 vol % saturates, viscosity index between 80 and 120; Group II, ≦0.03 wt. % sulfur, and ≧90 vol % saturates, viscosity index between 80 and 120; Group III, ≦0.03 wt. % sulfur, and ≧90 vol % saturates, viscosity index >120; Group IV, all polyalphaolefins. Hydrotreated basestocks and catalytically dewaxed basestocks, because of their low sulfur and aromatics content, generally fall into the Group II and Group III categories. Polyalphaolefins (Group IV basestocks) are synthetic base oils prepared from various alpha olefins and are substantially free of sulfur and aromatics. Polyalphaolefins may also be used as Component C of this invention. Furthermore, blends of Group II, Group III and/or Group IV base oils may also be used as Component C of this invention. Further, the base oils suitable for use in the present invention may contain some Group I basestocks provided that the total base oil composition contains <0.03 wt. % sulfur and >90 volume % saturates.

There is no limitation as to the chemical composition of the various basestocks used in component C. For example, the proportions of aromatics, paraffinics, and naphthenics in the various Group II and Group III oils can vary substantially. This composition is generally determined by the degree of refining and the source of the crude used to produce the oil. It is preferred to have a basestock that is high in paraffinic content, i.e. >60 vol %.

The base oil (C), of the present invention, is present in an amount of from about 90 to 99.75 wt. % based on the total weight of the turbine lubricating oil.

Component D—Rust Inhibitor(s)

If present, any type of rust inhibitor may be used in this invention. Suitable acidic rust inhibitors for use in the present invention include the reaction products obtained by reacting a monocarboxylic acid, a polyalkylene polyamine and an alkenyl succinic anhydride, such as those taught in U.S. Pat. No. 4,101,429, hereby incorporated by reference. When compatibility in the presence of water and contaminants is required, the use of neutral rust inhibitors is preferred over acidic rust inhibitors because it has been found that they provide improved filterability. The concentration of the rust inhibitor(s) can vary from 0.02 to 0.5 wt. %. The term "neutral rust inhibitors", in the present invention, means rust inhibitors that are essentially free of a —COOH functional group.

The neutral rust inhibitors, suitable for use in the present invention, include any rust inhibitors that are essentially free of a —COOH group(s). Preferably, the neutral rust inhibitors are hydrocarbyl esters of the formula: $R(COOR')_n$, wherein R and R' are hydrocarbyl groups, or hydroxyhydrocarbyl groups, containing 1 to about 40 carbon atoms, preferably 8 to 20 carbon atoms, and n is 1 to about 5. The esters contain at least one, and preferably from 1 to 5 hydroxy groups in the molecule. They may all be attached to R or R' or they may be attached to R and R' in varying proportions. Further, the hydroxy groups can be at any position or positions along the chain of R or R'. It will be appreciated that the maximum number of groups COOR' that are present on the hydrocarbyl or hydroxyhydrocarbyl group R will vary depending on the number of carbon atoms in R.

The hydrocarbyl esters can be prepared by conventional esterification procedures from a suitable alcohol and an acid, acid halide, acid anhydride or mixtures thereof. In addition, the esters of the invention can be prepared by conventional methods of transesterification.

Typically, the neutral rust inhibitors will have a TAN of less than 10 mg KOH/g. Preferred esters include, but are not limited to, octyloleyl malate, dioleyl malate, pentaerythritol monooleate and glycerol monooleate.

By "essentially free", it is meant that the starting acids, acid halides, acid anhydrides or mixtures thereof used in preparing the neutral rust inhibitors are reacted with an amount of alcohol sufficient to theoretically convert the —COOH groups to esters.

Another class of preferred neutral rust inhibitors includes aspartic acid diesters of a 1-(2-hydroxyethyl)-2-heptadecenyl imidazoline. This imidazoline is primarily a mixture of diester of L-aspartic acid and an imidazoline based on the reaction between oleic acid and aminoethanolamine. Esters of this type are commercially available from Mona Industries, Inc. as Monacor® 39.

Succinimide and succinamide compounds represented by the formulae (I) may also be used as rust inhibitors in the present invention. These compounds may be used alone or in combination with one or more neutral or acidic rust inhibitors described above:

(I)

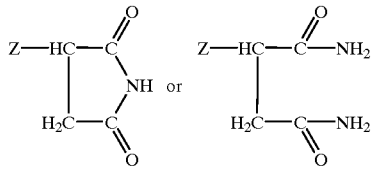

wherein Z is a group $R_1R_2CH$—, in which $R_1$ and $R_2$ are each independently straight- or branched-chain hydrocarbon groups containing from 1 to 34 carbon atoms and the total number of carbon atoms in the groups $R_1$ and $R_2$ is from 11 to 35.

In formulae (I), the radical Z may be, for example, 1-methylpentadecyl, 1-propyltridecenyl, 1-pentyltridecenyl, 1-tridecylpentadecenyl or 1-tetradecyleicosenyl. Preferably, the number of carbon atoms in the groups $R_1$ and $R_2$ is from 16 to 28 and more commonly 18 to 24. It is especially preferred that the total number of carbon atoms in $R_1$ and $R_2$ is about 20 to 22. The preferred compound represented by formulae (I) is the succinimide shown, the preferred succinimide being a 3-$C_{18-24}$ alkenyl-2,5-pyrrolidione. A more preferred embodiment of this succinimide contains a mixture of alkenyl groups having from 18 to 24 carbon atoms.

In one aspect of the invention, the compounds represented by formulae (I) have a titratable acid number (TAN) of about 80 to about 140 mg KOH/g, preferably about 110 mg KOH/g. The TAN is determined in accordance with ASTM D 664.

These compounds are commercially available or may be made by the application or adaptation of known techniques (see for example EP-A-0389237).

Typically, the additive components of this invention (A, B, and D, when present) are added to the base oil (C) in the form of an additive package concentrate. The total amount of additive components in the concentrates generally varies from 20 to 95 wt. % or more, with the balance being diluent oil. The diluent oil may be the Group II or higher base oils of this invention, conventional Group I base oils, as defined above, or a hydrocarbon, preferably aromatic, solvent or mixtures thereof. The concentrates may contain other additives. Examples of other additives include demulsifiers, copper corrosion inhibitors, ashless antiwear additives and supplemental antioxidants such as hindered phenolics. Examples of hindered phenolic antioxidants that may be used include 2,6-di-t-butylphenol, 2,4,6-tri-t-butylphenol, 4,4'-methylenebis(2,6-di-t-butylphenol), methylene bridged t-butylphenol mixtures, isooctyl 3,5-di-t-butyl-4-hydroxyhydrocinnamate, and thiodiethylenebis(3,5-di-t-butyl-4-hydroxy)hydrocinnamate. Typically, the additive package concentrates are added to the base oil (C) in an amount sufficient to provide from 0.25 to 2.0 wt. % of components (A), (B) and (D), if present, to the finished oil.

In a preferred embodiment of the present invention, the turbine lubricating oils are prepared without the addition of hindered phenolic antioxidants. There are a number of problems that may be associated with the use of hindered phenolics. There are toxicity issues related to the use of hindered phenolics that contain low levels of free phenol. Further, hindered phenolics under high temperatures can dealkylate and produce free phenol. Water extractability of certain water soluble phenolics is another potential problem. Thus a phenolic-free formulation may be desired.

The present invention is also directed to a method of improving the oxidative stability of a base oil, wherein said method comprises adding to a base oil having a sulfur content of less than 0.03 wt. % and greater than 90 volume % saturates (A) an amine antioxidant selected from the group consisting of alkylated diphenylamines, phenylnaphthylamines and mixtures thereof; and (B) a sulfur containing additive selected from the group consisting of sulfurized olefins, sulfurized fatty acids, ashless dithiocarbamates, tetraalkylthiuram disulfides and mixtures thereof.

The turbine oils of the present invention may be used in other applications including circulating systems, compressors, ashless hydraulic systems, and other equipment where oxidation stability is of primary importance.

EXAMPLES

It is important to note that the use of sulfur containing additives (those defined in Component B) in finished turbine oils can be limited due to corrosion and significant increases in sludge during oxidation of the oil. Suitable oils for turbine applications are required to pass certain tests demonstrating acceptable corrosion and sludge control.

The following Examples show the superior oxidation stability of the turbine oils of this invention as well as adequate sludge and corrosion control.

Example I

A series of 32 oils were blended using the components, concentrations, and basestocks indicated in Table I. The oils were blended by combining all components with the oils and heating the oils at 50° C., with adequate mixing, for 1 hour. The components used were as follows:

Corrosion Inhibitor—Derivatized tolyltriazole corrosion inhibitor.

Ashless DTC—Methylenebis(di-n-butyl-dithiocarbamate) containing approximately 30 wt % sulfur. This additive represents component B of the lubricant composition.

Sulfurized Olefin—A C16–C18 sulfurized olefin containing approximately 12 wt. % sulfur. This additive represents component B of the lubricant composition.

Acidic Rust Inhibitor—HiTEC® 536 rust inhibitor, a derivatized acidic rust inhibitor available from Ethyl Corporation.

PANA—Phenyl-alpha-naphthylamine containing approximately 6.6 wt. % nitrogen. This additive represents component A of the lubricant composition.

2,6-DTBP—2,6-di-tert-butylphenol.

DPA—A styryl octyl alkylated diphenylamine containing approximately 4.3 wt. % nitrogen. This additive represents component A of the present lubricant composition.

Neutral Rust Inhibitor—Pentaerythritol monooleate neutral rust inhibitor. This additive represents component D of the lubricant composition.

100 N Group II—A basestock containing approximately 0.01 wt % sulfur and a viscosity index of 99. This represents C of the lubricant composition.

100 N Group I—A basestock containing approximately 0.15 wt % sulfur and a viscosity index of 85.

100 N High VI Group II—A basestock containing <0.001 wt % sulfur and a viscosity index of 110. This represents C of the lubricant composition.

150 N Group I—A basestock containing 0.33 wt % sulfur and a viscosity index of 94.

All the formulated oils in Table I were evaluated in the Rotary Bomb Oxidation Test ASTM D 2272. The Rotary Bomb Oxidation Test (RBOT) is a turbine oil oxidation test used as a quality control tool for new and used turbine oils of known composition, as well as a research tool for estimating the oxidative stability of experimental oils. The test evaluates the oxidative stability of a turbine oil at elevated temperatures and oxygen pressures and in the presence of a copper coil oxidation catalyst and water. A rotating glass bomb provides maximum oil-oxygen contact. Results are reported as the time to a 25 psi drop in oxygen pressure. The RBOT results for all 32 oils are shown in Table I.

The synergism between the alkylated diphenylamine (DPA) and sulfurized olefins and/or ashless dithiocarbamates (Ashless DTC) is shown in the results for oils 1 through 16 in Table I and in FIG. 1. Note that the sulfurized additives only (Oils 1 through 5), or the DPA only (Oil 6), are inferior at providing oxidation protection in the low sulfur, hydrotreated Group II oil, i.e., the induction times are low. However, when the sulfurized additives are combined with the DPA (Oils 12 through 16), a very high level of oxidation protection is seen, i.e. the induction times are very high. A very high level of oxidation protection is also seen when the sulfurized additives and the DPA are combined in the presence of a corrosion inhibitor and a neutral rust inhibitor (Oils 7 through 11).

Figure 2:
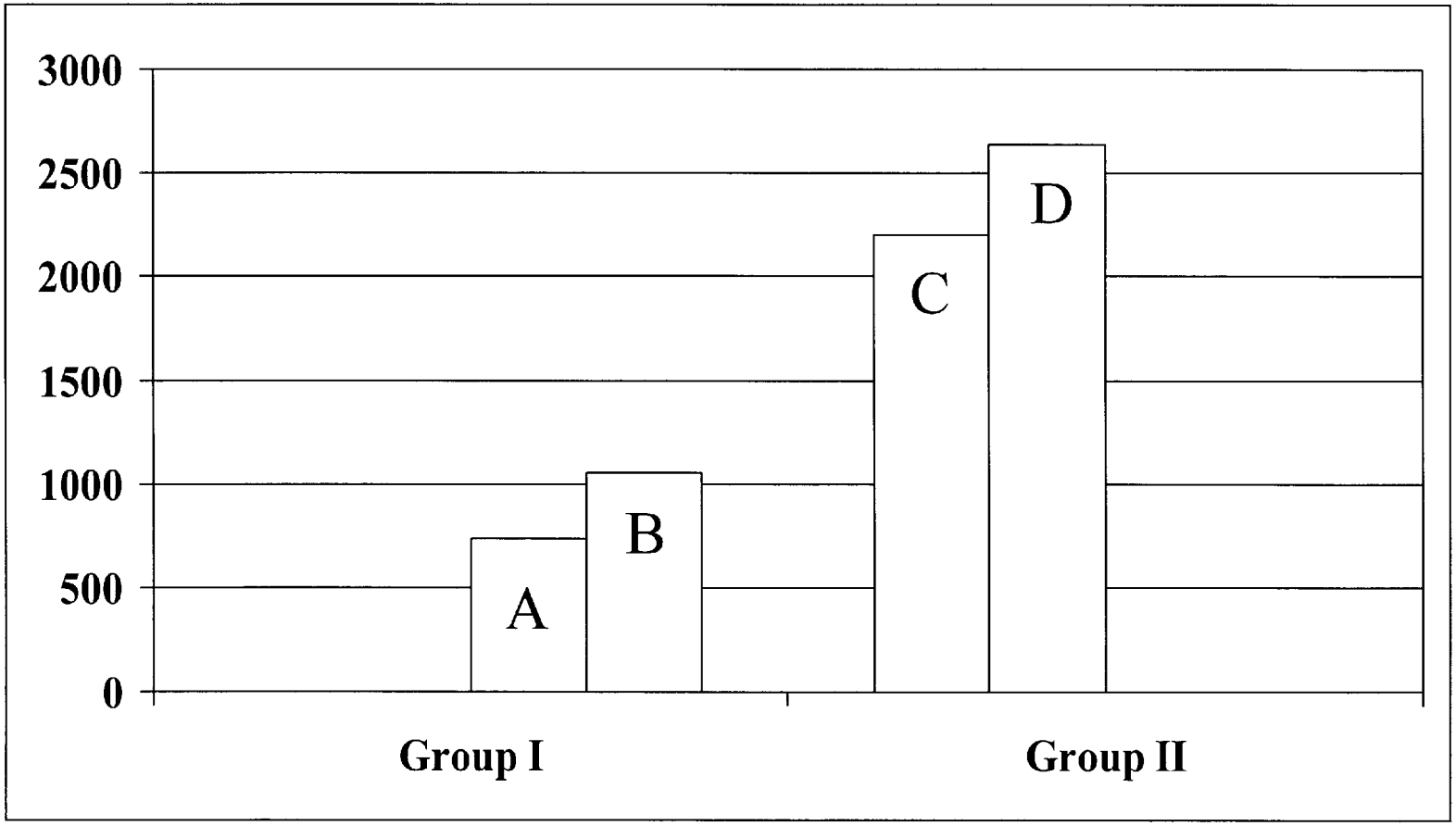
FIG. 2 is a graph showing the performance of sulfurized additive/amine antioxidant combinations in different basestock types.

The superior oxidative stability that this sulfurized additive/DPA combination provides to hydrotreated Group II oil s is shown when comparing oils 7, 20, 21 and 22 in Table I and in FIG. 2. The hydrotreated low sulfur Group II oils (7 and 21) are significantly more oxidatively stable than the conventional sulfur containing Group I oils (20 and 22). In FIG. 2, the basestocks tested were as follows: A was the 100 N Group I basestock described above, B was the 150 N Group I basestock, described above, C was the 100 N Group II basestock, described above, and D was the 100 N High VI Group II basestock, described above.

A comparison between oil 7 and oil 19 shows that both acidic rust inhibitors (19) and neutral rust inhibitors (7) may be used in combination with the sulfurized additives and DPA of this invention. Neutral rust inhibitors, however, are often preferred because of their effectiveness at controlling filterability in the finished turbine oils.

Oils 17 and 18 show that the corrosion and rust inhibitors alone (17) or the combination of corrosion and rust inhibitors with the sulfurized additive Ashless DTC (18) are ineffective at stabilizing the low sulfur hydrotreated group II oil.

Oils 23 and 24 show that other combinations of corrosion and rust inhibitors are effective at stabilizing the low sulfur hydrotreated Group II oil. In oil 23 the ashless DTC and DPA are used in combination with a neutral rust inhibitor only. In oil 24 the ashless DTC and DPA are used in combination with a corrosion inhibitor only.

Oils 25 through 29 show the effectiveness of this invention at potential ranges of practical treat levels that might be used. The ashless DTC varies from 0.05 to 0.15 wt %. The DPA varies from 0.2 to 0.4 wt %. Of course, lower ashless DTC and DPA levels in the finished oil will produce a less oxidatively stable oil. However, the combination of Ashless DTC and DPA provided much better oxidation protection in Group II basestocks as compared to Group I basestocks. In the case where oxidation performance equivalent to that obtained in a Group I basestock is required, lower levels of Ashless DTC and DPA can be used in Group II (or higher) basestocks (Compare oil 29 with oil 20 and oil 25 with oil 22). Further, the improved oxidation performance without sludging in Group II (or higher) basestocks, is beneficial for turbine applications.

Comparison of oil 25 with oil 30 shows that a supplemental antioxidant may be used as part of this invention to further improve the oxidative stability of the low sulfur, hydrotreated, Group II oil. The supplemental antioxidant in oil 30 is 2,6-di-t-butylphenol and this antioxidant does improve the oxidative stability of oil 30 relative to oil 25.

Oil 31 utilizes phenyl-alpha-naphthylamine (PANA) in combination with DPA as part of this invention while oil 32 utilizes phenyl-alpha-naphthylamine in combination with DPA and a phenolic antioxidant in place of the sulfur-containing additives. Note that when PANA is used in preparing the finished oils of this invention, an oil with less additives (0.55 wt % versus 0.7 wt %) and greater oxidative stability (1554 min versus 1300 min) is produced.

| Sample ID | Corrosion Inhibitor (g) | Ashless DTC (g) | Sulfur-ized Olefin (g) | Acidic Rust Inhibitor (g) | PANA (g) | 2,6-DTBP (g) | DPA (g) | Neutral Rust Inhibitor (g) | 100 N Group II (g) | 100 N Group I (g) | 100 N High VI Group II (g) | 150 N Group I (g) | Total (g) | RBOT (min) |
|---|---|---|---|---|---|---|---|---|---|---|---|---|---|---|
| 1* | | 0.200 | | | | | | | 99.800 | | | | 100 | 34 |
| 2* | | 0.150 | 0.125 | | | | | | 99.725 | | | | 100 | 86 |
| 3* | | 0.100 | 0.250 | | | | | | 99.650 | | | | 100 | 106 |
| 4* | | 0.050 | 0.375 | | | | | | 99.575 | | | | 100 | 121 |
| 5* | | | 0.500 | | | | | | 99.500 | | | | 100 | 125 |
| 6* | | | | | | | 0.500 | | 99.500 | | | | 100 | 207 |
| 7 | 0.050 | 0.200 | | | | | 0.250 | 0.200 | 99.300 | | | | 100 | 2205 |
| 8 | 0.050 | 0.150 | 0.125 | | | | 0.250 | 0.200 | 99.225 | | | | 100 | 1706 |
| 9 | 0.050 | 0.100 | 0.250 | | | | 0.250 | 0.200 | 99.150 | | | | 100 | 1847 |
| 10 | 0.050 | 0.050 | 0.375 | | | | 0.250 | 0.200 | 99.075 | | | | 100 | 1569 |
| 11 | 0.050 | | 0.500 | | | | 0.250 | 0.200 | 99.000 | | | | 100 | 1219 |
| 12 | | 0.200 | | | | | 0.250 | | 99.550 | | | | 100 | 1671 |
| 13 | | 0.150 | 0.125 | | | | 0.250 | | 99.475 | | | | 100 | 2043 |
| 14 | | 0.100 | 0.250 | | | | 0.250 | | 99.400 | | | | 100 | 1826 |
| 15 | | 0.050 | 0.375 | | | | 0.250 | | 99.325 | | | | 100 | 1542 |
| 16 | | | 0.500 | | | | 0.250 | | 99.250 | | | | 100 | 1360 |
| 17* | 0.050 | | | | | | | 0.200 | 99.750 | | | | 100 | 33 |
| 18* | 0.050 | 0.200 | | | | | | 0.200 | 99.550 | | | | 100 | 31 |
| 19 | 0.050 | 0.200 | | 0.200 | | | 0.250 | | 99.300 | | | | 100 | 2486 |
| 20* | 0.050 | 0.200 | | | | | 0.250 | 0.200 | | 99.300 | | | 100 | 1052 |
| 21 | 0.050 | 0.200 | | | | | 0.250 | 0.200 | | | 99.300 | | 100 | 2638 |
| 22* | 0.050 | 0.200 | | | | | 0.250 | 0.200 | | | | 99.300 | 100 | 731 |
| 23 | | 0.200 | | | | | 0.250 | 0.200 | 99.350 | | | | 100 | 1720 |
| 24 | 0.050 | 0.200 | | | | | 0.250 | | 99.500 | | | | 100 | 2990 |
| 25 | 0.050 | 0.050 | | | | | 0.200 | 0.200 | 99.500 | | | | 100 | 715 |
| 26 | 0.050 | 0.050 | | | | | 0.400 | 0.200 | 99.300 | | | | 100 | 709 |
| 27 | 0.050 | 0.150 | | | | | 0.200 | 0.200 | 99.400 | | | | 100 | 1542 |
| 28 | 0.050 | 0.150 | | | | | 0.400 | 0.200 | 99.200 | | | | 100 | 1758 |
| 29 | 0.050 | 0.100 | | | | | 0.300 | 0.200 | 99.350 | | | | 100 | 1050 |
| 30 | 0.050 | 0.050 | | | | 0.200 | 0.200 | 0.200 | 99.300 | | | | 100 | 929 |
| 31 | 0.050 | 0.050 | | | 0.050 | | 0.200 | 0.200 | 99.450 | | | | 100 | 1554 |
| 32* | 0.050 | | | | 0.100 | 0.250 | 0.100 | 0.200 | 99.300 | | | | 100 | 1300 |

*Comparative Example

Example II

A series of oils were blended using the components, concentrations, and basestocks indicated in Table II. The oils were blended by combining all components with the oils and heating the oils at 50° C., with adequate mixing, for 1 hour. The components used were those identified in example I and the following:

SBHHC—Thioethylenebis(3,5-di-t-butyl-4-hydroxyhydrocinnamate), contains approximately 5 wt % sulfur Octyl BHHC—Isooctyl 3,5-di-t-butyl-4-hydroxyhydrocinnamate Oils 33 through 44 represent antioxidant combinations that are commonly used in turbine oil applications while oils 12 and 16 represent the antioxidant combinations for turbine oils of this invention. These oils were evaluated in the RBOT ASTM D 2272 as defined in Example I. The RBOT results are reported in Table II.

Note that the low sulfur hydrotreated Group II oils containing the commonly used antioxidant systems (Oils 34, 36, 38, 41, and 44) are not substantially different in oxidative stability from the sulfur containing Group I oils containing the same antioxidant systems. In some cases the low sulfur hydrotreated Group II oils are slightly less oxidatively stable than the sulfur containing Group I oils (34 versus 33, 38 versus 37, 41 versus 39, and 44 versus 42) while in other cases they are slightly more oxidatively stable (36 versus 35, 41 versus 40, and 44 versus 43). In the cases where the low sulfur hydrotreated Group II oils are more oxidatively stable than the sulfur containing Group I oils, the differences are small.

Note that oils 33 through 38 contain a sulfurized antioxidant used in combination with the DPA. The antioxidant SBHHC contains approximately 5 wt % sulfur. In oils 35 and 36, 0.019 wt % sulfur is being delivered to the oil from antioxidant SBHHC. This sulfur content falls within the range specified for component B of the invention. However, SBHHC is not an effective sulfurized additive for improving the oxidative stability of the low sulfur hydrotreated Group II oil, i.e. the RBOT induction times using SBHHC are not substantially different between the Group I and Group II oils. Furthermore, SBHHC is considerably more costly than the sulfurized olefins and ashless DTC's in component B of the invention. It is not practical to increase the sulfur content of the oil by adding higher treat levels of SBHHC because its sulfur content is relatively low, requiring substantial treat levels.

Oils 12 and 16 represent compositions for this invention. Note the superior oxidative stability of these oils relative to oils 33 through 44.

TABLE II

| Sample ID | Antioxidant ID | Antioxidant Level (wt %) | DPA Level (wt %) | Basestock ID | RBOT Average of Duplicates (min) |
|---|---|---|---|---|---|
| 33* | SBHHC | 0.25 | 0.25 | 100N Group I | 448 |
| 34* | SBHHC | 0.25 | 0.25 | 100N Group II | 392 |
| 35* | SBHHC | 0.375 | 0.125 | 100N Group I | 324 |
| 36* | SBHHC | 0.375 | 0.125 | 100N Group II | 426 |
| 37* | SBHHC | 0.125 | 0.375 | 100N Group I | 434 |
| 38* | SBHHC | 0.125 | 0.375 | 100N Group II | 366 |
| 39* | 2,6-DTBP | 0.25 | 0.25 | 100N Group I | 670 |
| 40* | 2,6-DTBP | 0.25 | 0.25 | 150N Group I | 360 |
| 41* | 2,6-DTBP | 0.25 | 0.25 | 100N Group II | 549 |
| 42* | Octyl BHHC | 0.25 | 0.25 | 100N Group I | 461 |
| 43* | Octyl BHHC | 0.25 | 0.25 | 150N Group I | 255 |
| 44* | Octyl BHHC | 0.25 | 0.25 | 100N Group II | 286 |
| 12 | Ashless DTC | 0.2 | 0.25 | 100N Group II | 1671 |
| 16 | Sulfurized Olefin | 0.5 | 0.25 | 100N Group II | 1360 |

* Comparative Examples

Example III

A variety of tests have been developed to screen a finished turbine oils ability to control corrosion and sludge. One very useful test is the Nippon Oil Color Test (NOC). The NOC method is as follows: Four 50 ml beakers are filled with 45 g of the oil to be tested. Iron and copper coil catalysts (used for ASTM D 943) are added to each of the four beakers. The beakers are stored at 140° C. and after 4, 6, 8 and 10 days a beaker is removed from the oven and analyzed for color (ASTM D 1500) and sludge content. The copper coil is rated according to ASTM D 130 rating chart.

Oils 25 through 31 were evaluated in the Nippon Oil Color Test for color formation by ASTM D 1500, and sludge formation by the weight of sludge produced in milligrams. Acceptable color and sludge results were obtained for all the oils, i.e. less than 8.0 for color and less than 10 milligrams of sludge after 10 days of oil aging.

This invention is susceptible to considerable variation in its practice. Accordingly, this invention is not limited to the specific exemplifications set forth hereinabove. Rather, this invention is within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part of the invention under the doctrine of equivalents.

We claim:

1. A turbine lubricating oil comprising:

(A) an amine antioxidant comprising a mixture of alkylated diphenylamines and phenyl-naphthylamines;

(B) a sulfur-containing additive selected from the group consisting of sulfurized olefins, ashless dithiocarbamates, tetraalkylthiuram disulfides and mixtures thereof; and (C) a base mineral oil having a sulfur content of less than 0.03 wt. % and greater than 90 volume % saturates.

2. A turbine lubricating oil according to claim 1 further comprising at least one additive selected from the group consisting of demulsifiers, copper corrosion inhibitors, antiwear additives and supplemental antioxidants.

3. A turbine lubricating oil according to claim 2 further comprising at least one hindered phenolic antioxidant.

4. A turbine lubricating oil according to claim 1 that contains no hindered phenolic antioxidants.

5. A turbine lubricating oil according to claim 1 wherein the amine antioxidant (A) is present in the finished turbine oil in an amount of from 0.04 to 0.5 wt. %.

6. A turbine lubricating oil according to claim 1 wherein the sulfur containing component (B) comprises a sulfurized olefin.

7. A turbine lubricating oil according to claim 6 wherein the olefin of the sulfurized olefin has an average molecular weight of from 112 to about 351 g/mole.

8. A method of improving the oxidative stability of a base mineral oil, said method comprising adding to a base mineral oil having a sulfur content of less than 0.03 wt. % and greater than 90 volume % saturates (A) an amine antioxidant comprising a mixture of alkylated diphenylamines and phenyl-naphthylamines; and (B) a sulfur containing additive selected from the group consisting of sulfurized olefins, ashless dithiocarbamates, tetraalkylthiuram disulfides and mixtures thereof.

9. A turbine lubricating oil according to claim 1 wherein the sulfur containing compound (B) comprises an ashless dithiocarbamate.

10. A turbine lubricating oil according to claim 1 wherein the sulfur-containing compound (B) comprises a tetraalkylthiuram disulfide.

11. A turbine lubricating oil according to claim 1 wherein the sulfur-containing compound (B) comprises a mixture of at least one sulfurized olefin and at least one ashless dithiocarbamate.

12. A turbine lubricating oil according to claim 1 wherein the sulfur containing compound (B) is present in an amount sufficient to deliver between 0.005 wt. % and 0.07 wt. % of sulfur to the finished turbine oil.

13. A turbine lubricating oil according to claim 1 wherein the sulfur containing compound (B) contains less than 1.5 wt. % of active sulfur as determined by ASTM D 1662.

14. A turbine lubricating oil according to claim 1 further comprising (D) at least one rust inhibitor.

15. A turbine lubricating oil according to claim 14 wherein the rust inhibitor comprises at least one acidic rust inhibitor.

16. A turbine lubricating oil according to claim 14 wherein the rust inhibitor comprises at least one neutral rust inhibitor.

17. A turbine lubricating oil according to claim 14 wherein the rust inhibitor comprises at least one succinimide or succinamide compound selected from

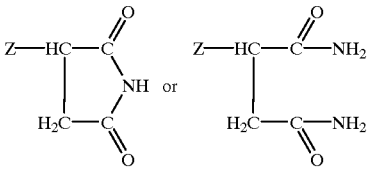

wherein Z is a group $R_1R_2CH$—, in which $R_1$ and $R_2$ are each independently straight- or branched-chain hydrocarbon groups containing from 1 to 34 carbon atoms and the total number of carbon atoms in the groups $R_1$ and $R_2$ is from 11 to 35.

18. A turbine lubricating oil according to claim 14 wherein the rust inhibitor comprises a mixture of at least one acidic rust inhibitor and at least one neutral rust inhibitor.

19. A turbine lubricating oil according to claim 14 wherein the rust inhibitor comprises a mixture of at least one acidic rust inhibitor and at least one succinimide or succinamide rust inhibitor.

20. A turbine lubricating oil according to claim 14 wherein the rust inhibitor comprises a mixture of at least one neutral rust inhibitor and at least one succinimide or succinamide rust inhibitor.

21. A turbine lubricating oil according to claim 14 wherein said turbine lubricating oil contains from 0.02 to 0.5 wt. % rust inhibitor(s).

22. A method of improving the oxidative stability of a base oil according to claim 8 further comprising the addition of (D) at least one rust inhibitor to said base oil.

* * * * *